US006981740B1

(12) United States Patent
O'Donnell et al.

(10) Patent No.: US 6,981,740 B1
(45) Date of Patent: Jan. 3, 2006

(54) PORTABLE SKI WORK JIG

(76) Inventors: Serena O'Donnell, P.O. Box 230972, Anchorage, AK (US) 99523; Steven O'Donnell, P.O. Box 230972, Anchorage, AK (US) 99523

( * ) Notice: Subject to any disclaimer, the term of this patent is extended or adjusted under 35 U.S.C. 154(b) by 0 days.

(21) Appl. No.: 10/957,236

(22) Filed: Oct. 1, 2004

(51) Int. Cl.
*B23Q 3/00* (2006.01)

(52) U.S. Cl. ..... 296/296; 269/906

(58) Field of Classification Search ..... 269/296, 269/906, 289 R, 901
See application file for complete search history.

(56) References Cited

U.S. PATENT DOCUMENTS 3,826,482 A * 7/1974 Tourangeau ..... 269/88
3,963,234 A * 6/1976 Bejtlich ..... 269/296
4,175,736 A * 11/1979 Dietlein ..... 269/88
5,150,887 A * 9/1992 Weissenborn et al. ..... 269/71
6,585,248 B2 * 7/2003 Baud ..... 269/296
6,880,817 B2 * 4/2005 Clarke ..... 269/50

* cited by examiner

*Primary Examiner*—Lee D. Wilson
(74) *Attorney, Agent, or Firm*—Michael J. Tavella

(57) ABSTRACT

A ski jig that has a center vice secured to a frame that has two wing members. The wing members are curved and sized to allow the ends of a Nordic type ski to rest on the wing members. In this way, the ends of the ski, including the tips, are fully supported at all times. Thus, a user can apply full pressure to the ski without fear of damaging it. The frame can be bolted to a table to secure it for use. The center vice is formed of two rectangular plates that abut the center of the device. A wing nut and bolt for the locking mechanism. The center of the ski is placed in the vice and the wing nut is tightened until the ski is secure. Pads, attached to the inside of the vice plates, protect the ski from damage.

10 Claims, 6 Drawing Sheets

PORTABLE SKI WORK JIG

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates jigs for skis and particularly to portable jigs for Nordic skis.

2. Description of the Prior Art

To keep skis at their optimum performance level, they must be regularly maintained. Routine maintenance typically, involves stripping and resetting wax one the base as well as sharpening edges. To do this kind of work, the ski must be firmly supported. Not only does such support free up the worker's hands, it also ensures that the work is done precisely and safely. Although downhill skis need this maintenance, they are easier to work with than Nordic skies, which are narrower and more flexible than downhill skies. Because of this, Nordic skis must be properly supported when doing maintenance to prevent damage to the ski.

To that end, ski jigs have been developed. One such device is found in U.S. Pat. No. 3,642,269, which teaches a large jig that attaches to the end of a table. A treadle us used to operate the vice portions of the device. The jig is large enough to hold two skis at one time. While this jig can be used to perform maintenance on skis, it is large, bulky, and not portable. Two examples of smaller benches are found in U.S. Pat. Nos. 3,826,482 and 3,963,234, which teach portable benches that can be temporarily attached to a table. Both devices include a means for securing a ski to the bench, a center vice portion and two end supports to hold the ends of the ski.

The problem with all of these devices is that they provide no support for the overall length of the ski. Support for the ski is found only at the vice in the center and at the two ends. The tip of the ski is not supported at all. As a result, the ski can be bent during operations such as waxing. This bending may affect the camber of the ski and, as a result, its performance.

BRIEF DESCRIPTION OF THE INVENTION

The instant invention overcomes these problems. It is a ski jig, for use with Nordic skis, that has a center vice secured to a frame that has two wing members. The wing members are curved and sized to allow the ends of the ski to rest on the wing members. In this way, the ends of the ski, including the tips, are fully supported at all times. Thus, when waxing, for example, a user can apply full pressure to the ski without fear of damaging it. The curved wing members have hollow centers that have spaces for bolts. The bolts allow the unit to be bolted to a table.

The center vice is formed of two rectangular plates that abut the center of the device. A wing nut and bolt for the locking mechanism. The center of the ski is placed in the vice and the wing nut is tightened until the ski is secure. Pads, attached to the inside of the vice plates, protect the ski from damage.

DETAILED DESCRIPTION OF THE INVENTION

Figure 1:
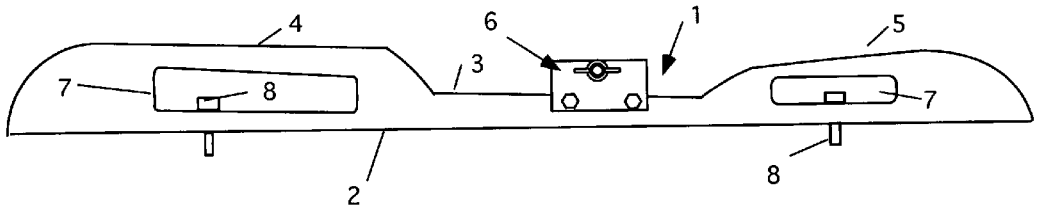
FIG. 1 is a side elevation view of the invention.

Referring now to FIG. 1, the invention 1 has a frame 2 that has a flat center portion 3, a front wing portion 4 and a rear wing portion 5. A vice 6 is attached to the center portion 3 of the frame as discussed below. The two wing portions 3 and 4 have center openings 7 as shown. These openings serve two purposes. First, the act as handles to allow the device to be easily handled and carried. Second, they act as receivers for bolts 8, which are used to secure the device to a bench or table for use. In this way, the device can be attached either permanently or temporarily to a table or bench as desired.

The two wings 3 and 4 have similar shapes. In the preferred embodiment, the front wing 3 is slightly longer than the rear wing 4. This is to account for the normal placement of the bindings, which tend to be towards the rear center of the ski. Of course, these dimensions and proportions can be readily changed as desired.

Each of the wings curves upward from the flat center portion 3. The flat center portion is designed to accommodate the thicker center portion of the ski as well as the bindings. (See, e.g., FIG. 5). The wings then have a gentle upward slope along the top of the wings as they extend out from the center as shown. Finally, the ends of the wings curve downward to the ends of the frame. This accommodates the tips and end of the ski. (See, e.g., FIGS. 6 and 7).

Figure 2:
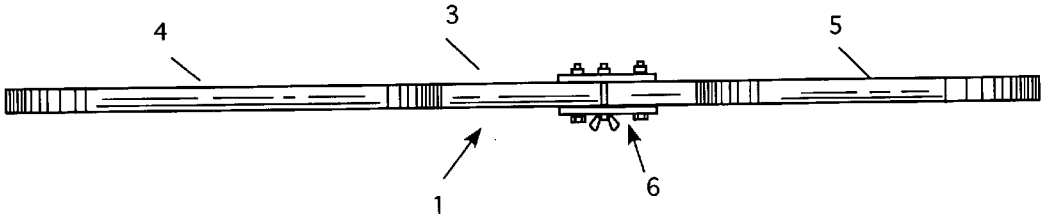
FIG. 2 is a top plan view of the invention.

FIG. 2 is a top plan view of the invention. This view shows that the frame 2 of the invention has a uniform thickness. In the preferred embodiment, the frame is designed to be slightly wider than the width of a typical ski. Note the position of the center vice.

Figure 3:
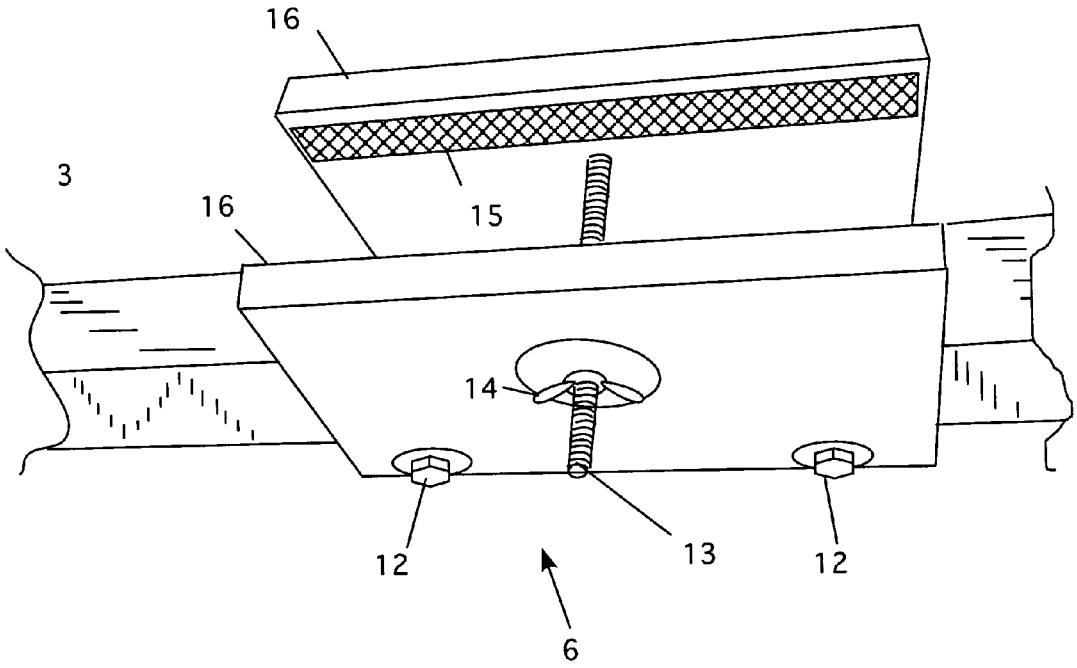
FIG. 3 is an enlarged top perspective view of the center vice.

FIG. 3 is an enlarged top perspective view of the center vice 6. As shown, the vice 6 is secured to the center portion 3 by bolts 12. A through bolt 13 and wing nut 14 are used to open and close the vice. Pads 15 are placed on the upper portions of the jaws 16. The pads protect the ski from scratches and damage caused by the vice 6.

As shown, the vice jaws are secured to the frame 2 at their bottoms. Thus, the jaws cannot move in and out freely like a normal set of vice jaws. Rather, these jaws are designed to lightly squeeze the ski by pivoting inward slightly at the top. This is accomplished by tightening the wing nut 14. The ski can be released simply by loosening the wing nut. The vice does not have to move a lot to securely hold the ski, because the ski is supported for almost its entire length.

Figure 4:
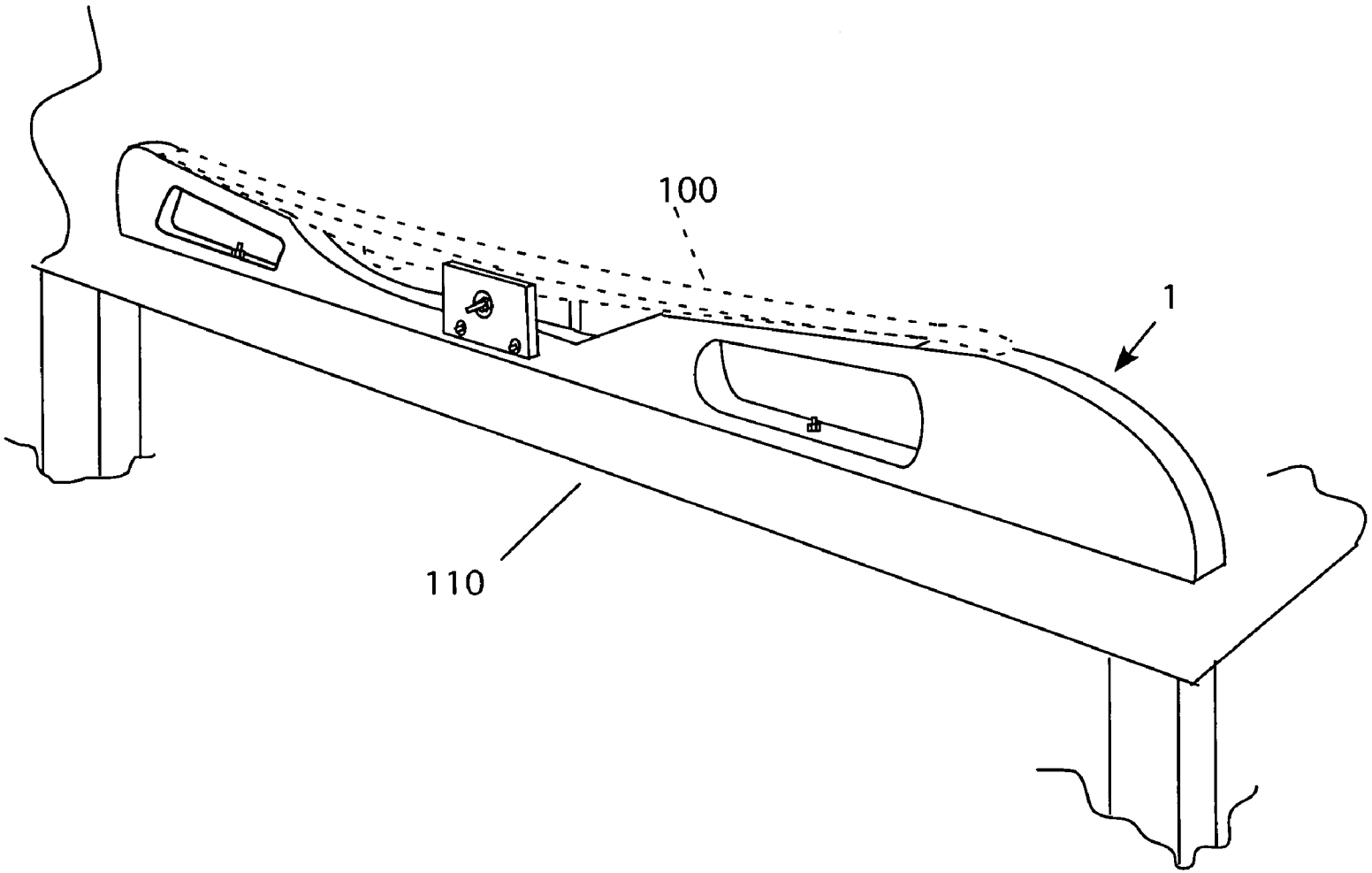
FIG. 4 is a perspective view of the invention showing a ski in place atop the invention.

FIG. 4 is a perspective view of the invention showing a ski in place atop the invention. Here, the frame 2 has a Nordic type ski 100 placed on it. Note how the ski rests on the two wing portions. Note also, how the center of the ski is held by the vice. This figure also shows a portion of a table upon which the jig is fastened. As mentioned above, bolt are used to fasten the jig to a support structure, such as a table or workbench for use.

Figure 5:
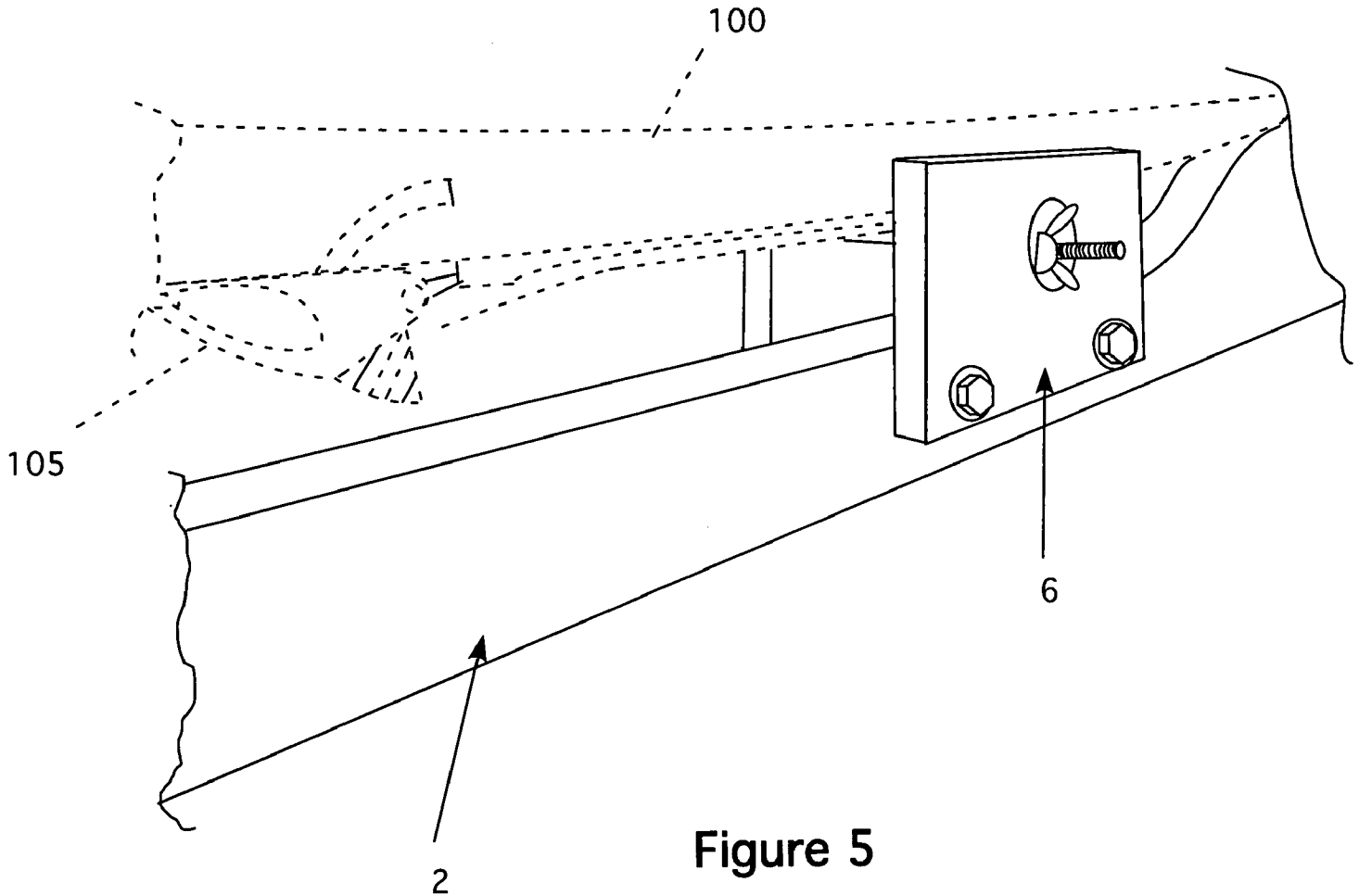
FIG. 5 is a perspective detail view of the center portion of the invention, showing the vice and a ski being held in place.

FIG. 5 is a perspective detail view of the center portion of the invention, showing the vice and a ski being held in place. Here, the center portion of the ski 100 is shown, along with a portion of the binding 101. Note that the frame 2 here is flattened in this area. This is to accommodate the thickness of the ski and binding at this point. This figure shows the ski being held lightly in the vice 6.

Figure 6:
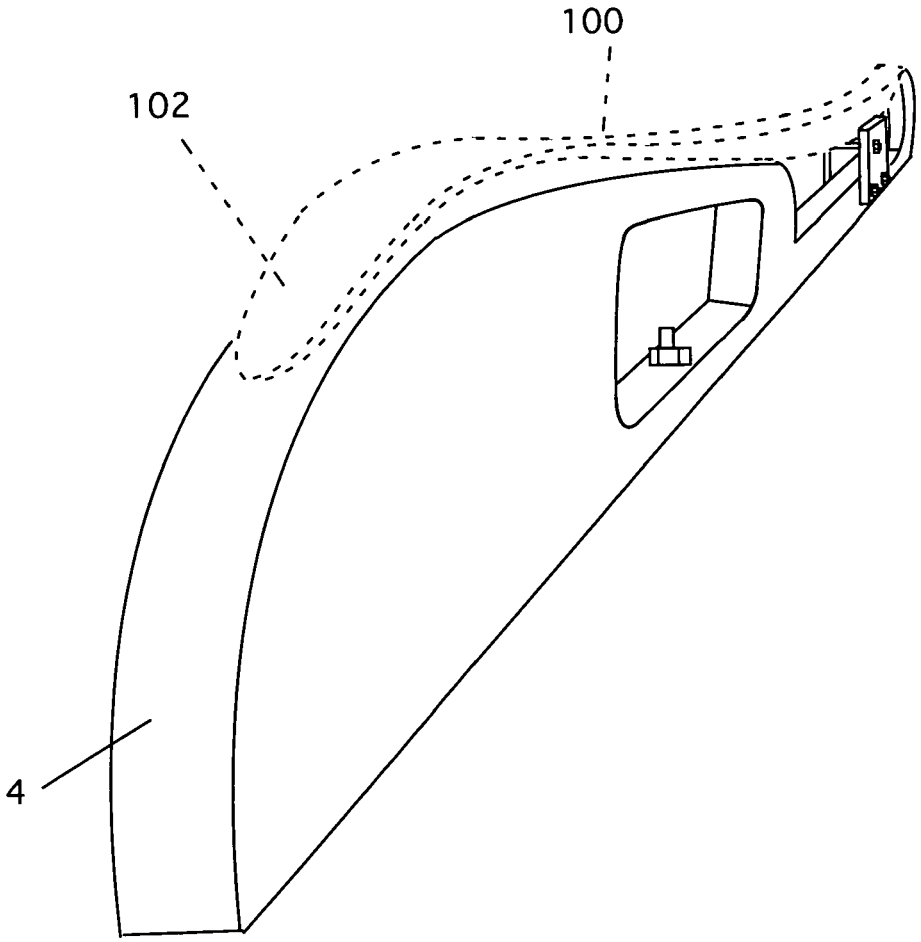
FIG. 6 is a front perspective view of the invention with a ski in place.

FIG. 6 is a front perspective view of the invention with a ski in place. Here, the tip 102 of the ski 100 is shown resting on the curved portion of the front wing 4. Note also that that body of the ski then follows the contour of the front wing as the ski extends back. This provides full support for the ski while one is working on it.

Figure 7:
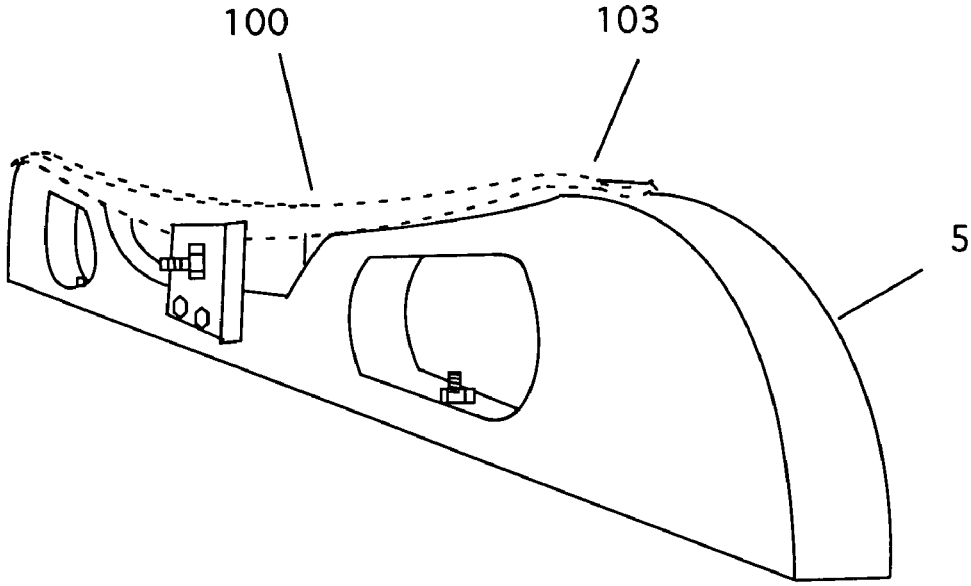
FIG. 7 is a rear perspective view of the invention with a ski in place.

FIG. 7 is a rear perspective view of the invention with a ski in place. Here, the back end 103 of the ski is shown resting on the curved portion of the rear wing 5. Note also that that body of the ski then follows the contour of the rear wing as the ski extends forward.

The dimensions of the work jig can be adjusted for different sized skis as is desired within the ordinary skill of the art.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A portable work jig for skis comprising:

a) a frame having a center flat portion, a bottom, a front wing and a rear wing, wherein the front wing having a curved surface extending upward from said center flat portion, an angled upper surface extending forward from said flat center portion and a descending curved front portion extending downward to the bottom of said frame, and further wherein the rear wing having a curved surface extending upward from said center flat portion, an angled upper surface extending rearward from said flat center portion and a descending curved back portion extending downward to the bottom of said frame; and b) a means for holding a ski, fixedly attached to said flat center portion.

2. The portable work jig for skis of claim 1 wherein the means for holding a ski comprises a vice.

3. The portable work jig for skis of claim 2 wherein the vice has a pair of oppositely disposed plates.

4. The portable work jig for skis of claim 3 wherein the pair of oppositely disposed plates are padded.

5. The portable work jig for skis of claim 3 wherein the pair of oppositely disposed plates each have a top and a bottom, and further wherein the bottoms of each of said pair of oppositely disposed plates are fixedly attached to the flat center portion of said frame.

6. The portable work jig for skis of claim 5 wherein the vice further includes a means for compressing the tops of said pair of oppositely disposed plates together.

7. The portable work jig for skis of claim 6 wherein the means for compressing the tops of said pair of oppositely disposed plates together comprises a through bolt and a wing nut.

8. The portable work jig for skis of claim 1 further comprising a means for securing said frame to a support structure.

9. The portable work jig for skis of claim 1 wherein the front and rear wings have handholds formed in them.

10. The portable work jig for skis of claim 8 wherein the means for securing said frame to a support structure comprise a pair of bolts.

* * * * *